US006578460B2

(12) United States Patent
Sartori

(10) Patent No.: US 6,578,460 B2
(45) Date of Patent: Jun. 17, 2003

(54) BLADE GUARD ASSEMBLY

(76) Inventor: James A. Sartori, 228 Countryside La., Williamsville, NY (US) 14221

( * ) Notice: Subject to any disclaimer, the term of this patent is extended or adjusted under 35 U.S.C. 154(b) by 0 days.

(21) Appl. No.: 09/748,414

(22) Filed: Dec. 26, 2000

(65) Prior Publication Data

US 2002/0117037 A1 Aug. 29, 2002

(51) Int. Cl.[7] ..... B27G 19/00; B27G 21/00; B27G 27/04

(52) U.S. Cl. ..... 83/100; 83/546; 83/477.2; 83/102.1; 144/251.1; 409/134

(58) Field of Search ..... 83/477.2, 102.1, 83/105, 106, 544, 545, 546, 823, DIG. 1, 100, 478; 144/251.1; 409/134

(56) References Cited

U.S. PATENT DOCUMENTS

| | | | | | |
|---|---|---|---|---|---|
| 307,112 | A | * | 10/1884 | Groff | 83/440.2 |
| 922,840 | A | * | 5/1909 | Bemiller | 83/100 |
| 1,082,870 | A | * | 12/1913 | Humason | 83/440.2 |
| 1,712,828 | A | * | 5/1929 | Klehm | 83/440.2 |
| 2,007,887 | A | * | 7/1935 | Tautz | 83/102.1 |
| 2,095,330 | A | * | 10/1937 | Hedgpeth | 83/102.1 |
| 2,466,325 | A | * | 4/1949 | Ocenasek | 83/102.1 |
| 2,572,326 | A | * | 10/1951 | Evans | 83/102.1 |
| 2,593,596 | A | * | 4/1952 | Olson | 83/102.1 |
| 2,754,857 | A | * | 7/1956 | Joslin | 144/251.1 |
| 2,786,496 | A | * | 3/1957 | Eschenburg | 83/102.1 |
| 3,580,307 | A | * | 5/1971 | Minetos | 83/544 |
| 3,880,032 | A | * | 4/1975 | Green | 83/102.1 |
| 3,884,101 | A | * | 5/1975 | Silkin | 83/544 |
| 4,418,597 | A | * | 12/1983 | Krusemark et al. | 83/478 |
| 4,576,072 | A | * | 3/1986 | Terpstra et al. | 83/102.1 |
| 4,625,604 | A | * | 12/1986 | Handler et al. | 83/102.1 |
| 5,231,906 | A | * | 8/1993 | Kogej | 83/478 |
| 5,447,085 | A | * | 9/1995 | Gochnauer | 83/102.1 |

* cited by examiner

*Primary Examiner*—Allan N. Shoap
*Assistant Examiner*—Jason Prone
(74) *Attorney, Agent, or Firm*—Richard K. Thomson

(57) ABSTRACT

A blade guard and lifter therefor surround the saw blade, interlocking when raised by a workpiece as a result of relative movement caused by a secondary linkage. Two pair of primary linkages pivotally connect the blade guard to the splitter. The dual secondary linkage pivotally attaches the parallel plates of the lifter to one of the two pivot points of the primary linkages. Any lifting force is resisted by the rigidity of the primary link that does not share a pivot point with the secondary linkage. A dust collector can be provided to the table saw to minimize respiratory hazards.

12 Claims, 3 Drawing Sheets

BLADE GUARD ASSEMBLY

BACKGROUND AND SUMMARY OF THE INVENTION

The present invention relates to safety equipment for table saws. More particularly, the present invention is directed to a blade guard assembly including a blade guard pivotally mounted to a portion of the table top by a parallelogram linkage and a lifter therefor that interlock to react lifting forces into one of the linkage elements.

Most table saws, if they have any guard at all, are equipped only with a plastic or light gauge sheet metal guard. These guards are pivoted to the splitter in a manner to provide movement that permits the guard to remain parallel to the table top. The only hold down force is provided by the weight of the guard, a minimal resistance force, indeed, when compared to the significant lifting force that can be produced in a workpiece. Further, any hold down pawls associated with such guards would prove ineffective since a significant downward force is essential for them to work.

The safety equipment of the present invention provides a suitable guard assembly for a table saw. The blade guard assembly includes a blade guard and a lifter for the blade guard. The blade guard is pivotally attached to the splitter by means of two primary links that are generally the same length, the two links being pivoted at each end and spaced by equal amounts at the top and bottom to form a parallelogram linkage that enables the blade guard to pivot upwardly about the pivot points and move rearward toward the splitter. A bearing protrudes laterally from side portions of the blade guard.

The lifter, formed by two interconnected identical plates, sandwiches the blade guard. The lifter is pivoted to the splitter by a secondary link that is considerably shorter than the two primary links. The secondary link is attached to the splitter at one of the two primary links' pivot points. This geometry produces forward movement of the lifter relative to the blade guard as the workpiece to be cut is shoved under the forward camming surface of the lifter. One of the rear portions of the lifter and the blade guard is equipped with a locking groove and the other with a locking rod. As the workpiece lifts the aft portion of the lifter, the secondary link causes the locking element on the lifter to move rearwardly engaging the locking element on the blade guard such that the lifter and blade guard become interlocked. The locking slot is equipped with serrated teeth to limit slippage between the locking rod and the slot. The interlocked unit will attempt to pivot about the secondary link's pivot point. Accordingly, any lifting force the workpiece experiences will be reacted into the primary link that does not share the pivot with the secondary link, i.e., the lifting force will be resisted by the stiffness of the primary link as the torsion of the workpiece attempts to axially compress the rigid primary link. The blade guard and lifter plates completely surround the saw blade and prevent accidental contact with person or property when no workpiece is being maneuvered toward the saw. A pair of platelets may be compressed by a bolt and wingnut to clamp the lifter and blade guard together to facilitate repetitive cutting of work pieces having identical thicknesses. Further, the table saw is provided with a dust removal system to reduce the effects of potentially hazardous dust resulting from currently compounded/treated materials. In addition, the dust removal system will minimize the cleanup needed following use of the saw.

In another embodiment of the saw guard, the saw blade is fixed in a fully elevated position. Some adjustable saws, at some of the lower blade positions, create a hazard to the user as a result of the teeth of the blade tending to project particles directly back toward the user's face. In the fully extended position, the teeth of the blade will tend to project the removed particulate matter downward below the table. Hence, by designing the guard and lifter to accommodate the blade in its fully extended position, and eliminating the raising, lowering and tilting mechanism associated with such a saw, the safety of the product is further enhanced. An additional advantage occurs in that the elimination of these mechanisms reduces the overall cost of the table saw. A single position table saw equipped with the blade guard of the present invention will provide a low cost, alternative to existing equipment that has maximum protection for the user. Such a saw will be ideal for school shops as well as some workplace and home uses.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1A:
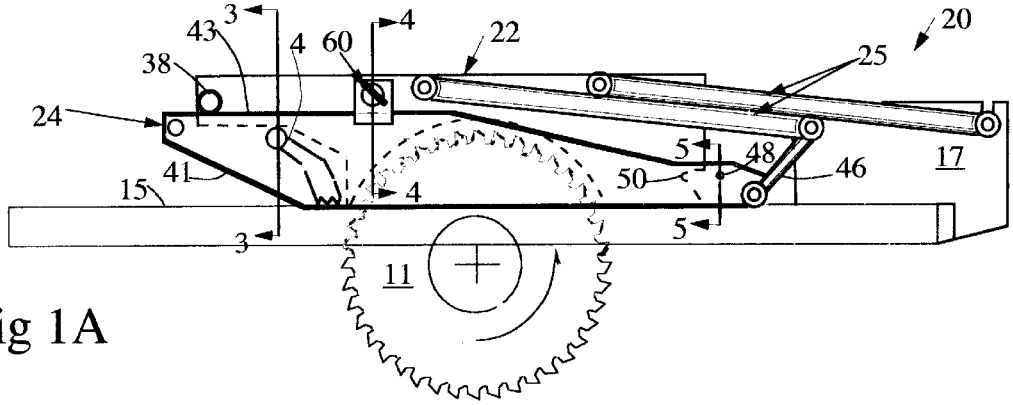
FIG. 1A is a side view of a first embodiment of the safety equipment of the present invention showing the equipment at an at rest position.
Figure 1B:
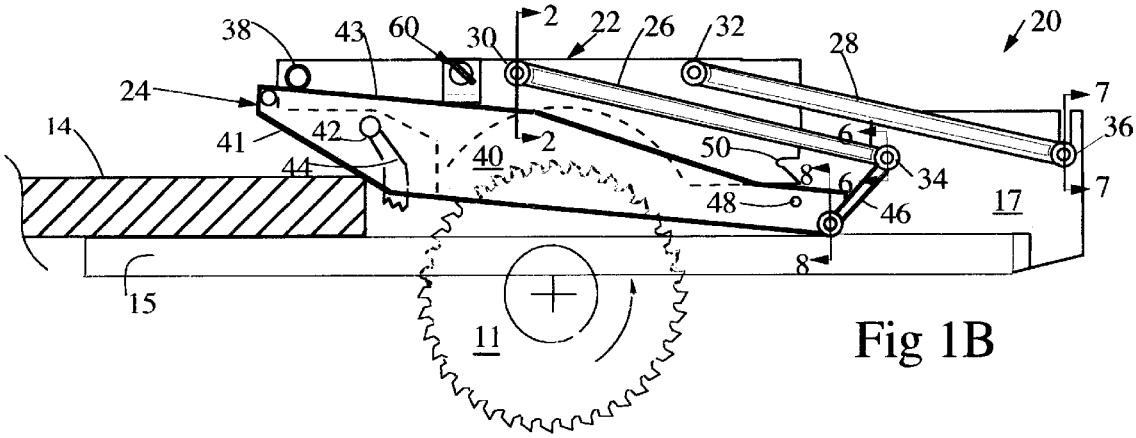
FIG. 1B is a side view of a first embodiment showing a workpiece entering the cutting zone.
Figure 1C:
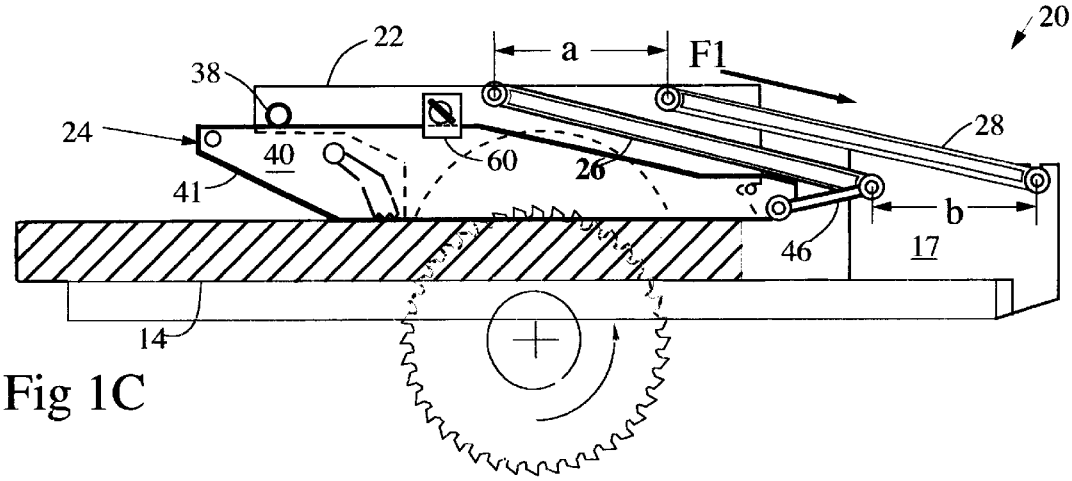
FIG. 1C is a side view of a first embodiment showing the saw engaging the workpiece.

The blade guard assembly of the present invention is shown in FIGS. 1A, 1B and 1C generally at 20. Blade guard assembly 20 comprises blade guard 22 and lifter 24. Blade guard 22 comprises a plate member contoured to completely surround the peripheral portion 13 of saw blade 11 that extends above table top 15. Blade guard 22 is pivoted to splitter 17 by linkage means 25. Linkage means 25 comprises two pairs 26, 28 of links pivotally mounted to blade guard 22 at their first ends 30, 32 respectively, and to the splitter at their second ends 34, 36. Links 26 and 28 preferably have an I-beam cross section for optimum strength to weight ratio and have the same, or generally the same, length. The distance 'a' between the pivots of ends 30 and 32 are equal, or substantially equal, to the distance 'b' between pivots of ends 34 and 36 in order to form a parallelogram linkage. Blade guard 22 pivots upwardly from a first at rest position on table top 15 by links 26, 28, to a second raised position where a workpiece 14 can fit beneath it to engage saw 11, blade guard 22 remaining parallel to the table top 15 during such pivotal movement.

Figure 2:
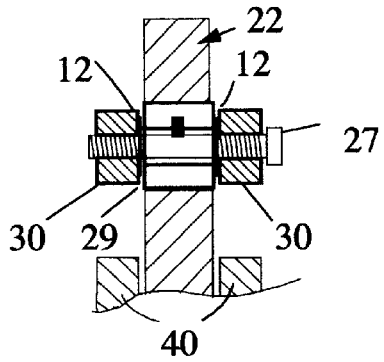
FIG. 2 is a cross-sectional end view as seen along 2—2 in FIG. 1B showing a detail of the pivot connection between the links and the blade guard.

FIG. 2 shows a detail of the pivot connection of links 26 to the blade guard 22. The configuration of the pivot connection for links 28 is identical, or substantially identical, with that shown for links 26. Ends 30 of dual links 26 are secured to blade guard 22 by bolt 27 which threadingly engages ends 30 and, with the help of shims 12 hold links 26 at an appropriately spaced distance from guard 22 to permit smooth pivotal movement. Bolt 27 passes through a NYLOK nut 29 (NYLOK is a registered trademark of USM Corp.) which prevents bolt 27 from rotating which could potentially allow loosening of the joint as a result of the repeated pivoting. A similar configuration is utilized in the attachment of lift bearings 38, the difference being that bearings 38 replace the link ends 30, 32.

Figure 3:
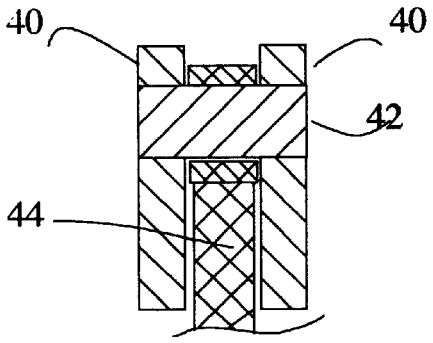
FIG. 3 is a cross-sectional end view as seen along 3—3 in FIG. 1A showing a detail of the pivot connection of the hold down pawl and the lifter.

Returning to FIGS. 1A–C, lifter 24 comprises a pair of plates 40 that sandwich blade guard 22 in a manner that permits relative movement between the lifter 24 and the guard 22. Each of the lead ends of plates 40 are provided with camming surface 41 which may be engaged by a workpiece 14 being pushed toward the saw. As seen in FIG. 1B, such engagement between the workpiece 14 and the camming surfaces 41 will cause the upper surfaces 43 of plates 40 to engage lift bearings 38 lifting blade guard 22 off of the top surfaces 15 of the table. Forward portions of plates 40 are tied together by dowel 42 (FIG. 3). Optionally, a pivoted toothed pawl 44 is rotationally mounted on dowel 42 and spring biased in a clockwise direction (as seen in FIGS. 1A–C) to exert an anti-kickback force on a workpiece 14. Any kickback of the workpeice 14 will be foiled as the toothed pawl 44 engages the upper surface thereof. The aft end of lifter 24 is pivoted to splitter 17 by a pair of secondary links 46. The pivot connection for secondary links 46 correspond to the pivot of either of the pairs of primary links 26 or 28.

Figure 6:
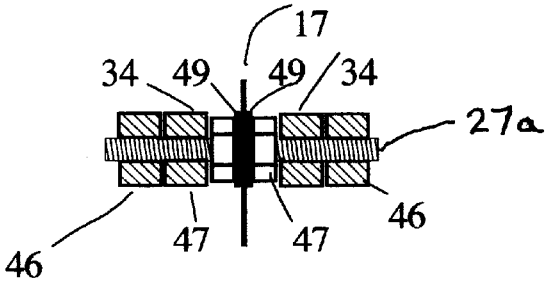
FIG. 6 is a cross-sectional end view as seen along 6—6 of FIG. 1B showing a detail of a first fulcrum for the blade guard assembly.
Figure 7:
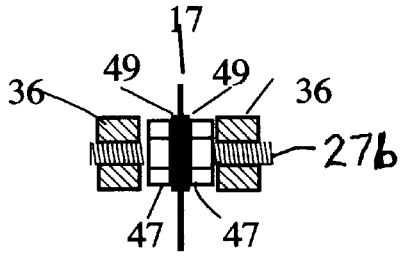
FIG. 7 is a cross-sectional end view as seen along 7—7 of FIG. 1B showing a detail of a second fulcrum for the blade guard assembly.
Figure 8:
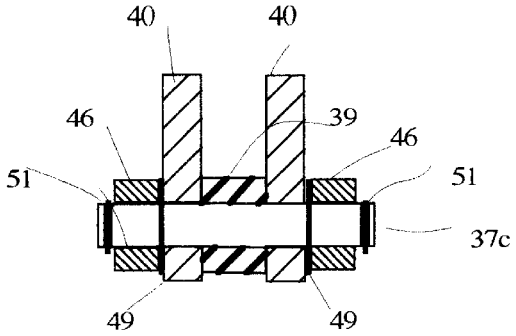
FIG. 8 is a cross-sectional end view as seen along 8—8 of FIG. 1B showing a detail of a third fulcrum of the blade guard assembly.
Figure 9:
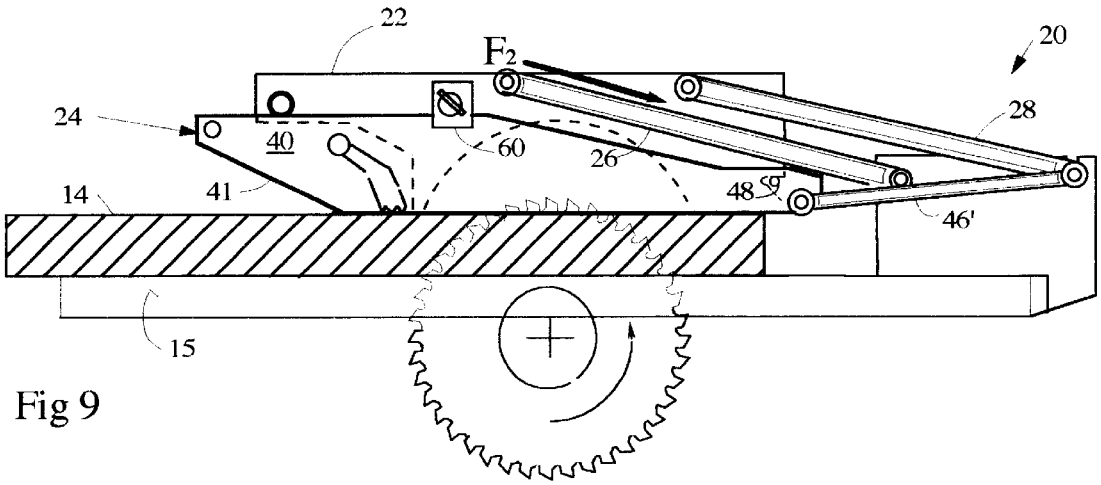
FIG. 9 is a side view of a second embodiment of the present invention.

As seen in the embodiment of FIGS. 1A–C, one end of the secondary links 46 are pivoted at the connection point to splitter 17 for links 26 (FIG. 6). Double ended stud 27*a* has ends 34 of links 26 and the ends of secondary links 46 threaded thereon. In addition, two adjustment nuts 47 and shims 49 are provided on either side of splitter 17 to maintain space to enable freedom of movement for the links 26 and 46. Ends 36 are threaded on stud 27*b* (FIG. 7) with adjustment nuts 47 and shims 49. The opposite end of secondary links 46 are pivotally connected to lifter 24 as shown in FIG. 8. A pivot shaft 27*c* mounts secondary links 46 on either side of plates 40 and cylindrical spacer 39 which maintains plates 40 at a width which does not touch the sides of blade guard 22. Shims 49, which may be TEFLON washers (TEFLON is a registered trademark of DuPont de Nemours and Company Corporation), maintain space between links 46 and plates 40 so they may pivot freely as needed. Circlips 51 maintains the pivot assembly together. The embodiment shown in FIG. 9 shows the secondary links 46' pivoted at the connection point for links 28. In this embodiment, the FIG. 6 and 7 pivots are reversed, the former having ends 34 of links 26 replacing ends 36 of links 28. The manner of operation of the two embodiments is identical in all particulars.

One of the blade guard 22 and the lifter 24 is provided with a locking rod 48 and the other with a locking slot 50. As seen in these embodiments, the locking rod 48 is provided of the lifter 24 and the slot 50 in guard 22. However, it will be appreciated that by reversing the direction of the slot 50, the rod 48 and slot 50 could be transposed without materially affecting the manner of operation. As seen in this first embodiment, as workpiece 14 raises lifter 24 from the position shown in FIG. 1B to that shown in FIG. 1C, links 46 cause plates to move rearwardly resulting in locking rod 48 entering locking slot 50. The tolerances between locking rod 48 and the rear portion of plates 40 will necessarily be tight in order that the thinnest workpiece thicknesses for the FIG. 1A embodiment are shown in Table I and those for the FIG. 9 embodiment in Table II. In Table I, Pr, which is the parallelogram radius (the lengths of links 26, 28), equals 30 inches. Dr, the lifter radius (the length of secondary links 46), is 7.2 inches. f, the fulcrum radius (the height that the pivot for links 46 are above the surface of table top 15), is 2.75 inches. o, which is the offset at rest (½ the thickness of the links 46), 0.25 inch. When a workpiece 14 having a thickness t is inserted, the blade guard will move to the right an amount identified as $X_{pos}$ while simultaneously the lifter moveto the left an amount identified as $X_{neg}$, the total closure being $X_{pos}+X_{neg}$.

$X_{pos}=X_t-X_O$ where $$X_O=Pr-\sqrt{(Pr^2-o^2)} \text{ and } X_t=Pr-\sqrt{Pr^2-(t+o)^2} \text{ and}$$

$$X_{neg}=Xr-X_I \text{ where}$$

$$Xr=Dr-\sqrt{(Dr^2-f^2)} \text{ and } X_I=Dr-\sqrt{Dr^2-[f-t]^2}$$

TABLE I

| Pr | 30 | T | Xt | Xpos | XI | Xneg | closure |
|---|---|---|---|---|---|---|---|
| Dr | 7.2 | 0 | 0.0010 | 0.000 | 0.546 | 0.000 | 0.00 |
| f | 2.75 | 0.125 | 0.0023 | 0.001 | 0.496 | −0.050 | 0.05 |
| o | 0.25 | 0.25 | 0.0042 | 0.003 | 0.448 | −0.098 | 0.10 |
| | | 0.375 | 0.0065 | 0.005 | 0.403 | −0.143 | 0.15 |
| | | 0.5 | 0.0094 | 0.008 | .0361 | −.0185 | 0.19 |
| | | 0.625 | 0.0128 | 0.012 | 0.321 | −0.225 | 0.24 |
| 0.00104168 | Xo | 0.75 | 0.0167 | 0.016 | 0.283 | −0263 | 0.28 |
| 0.00104168 | | 0.875 | 0.0211 | 0.020 | 0.248 | −0.297 | 0.32 |
| | | 1 | 0.0261 | 0.025 | 0.216 | −0.330 | 0.35 |
| 0.54586595 | Xr | 1.125 | 0.0315 | 0.030 | 0.186 | −0.360 | 0.39 |
| 0.546 | | 1.25 | 0.0375. | 0.036 | 0.158 | −0.388 | 0.42 |
| | | 1.375 | 0.0440 | 0.043 | 0.133 | −0.413 | 0.46 |
| | | 1.5 | 0.0511 | 0.050 | 0.109 | −0.437 | 0.49 |
| | 1.625 | | 0.0587 | 0.058 | 0.088 | −0.457 | 0.52 |
| | | 1.75 | 0.0667 | 0.066 | 0.070 | −0.476 | 0.54 |
| | | 1.875 | 0.0754 | 0.074 | 0.053 | −0.492 | 0.57 |
| | | 2 | 0.0845 | 0.083 | 0.039 | −0.507 | 0.59 |
| | | 2.125 | 0.0942 | 0.093 | 0.027 | −0.579 | 0.61 |
| | | 2.25 | 0.1043 | 0.103 | 0.017 | −0.526 | 0.63 |
| | | 2.375 | 0.1151 | 0.114 | 0.010 | −0.536 | 0.65 |
| | | 2.5 | 0.1263 | 0.125 | 0.004 | −0.542 | 0.67 |
| | | 2.625 | 0.1381 | 0.137 | 0.001 | −0.543 | 0.68 |
| | | 2.75 | 0.1504 | 0.149 | 0.000 | −0.546 | 0.70 |
| | | 2.875 | 0.1632 | 0.162 | 0.001 | −0.545 | 0.71 |
| | | 3 | 0.1766 | 0.176 | 0.004 | −0.542 | 0.72 |
| | | 3.125 | 0.1904 | 0.189 | 0.010 | −0.536 | 0.73 |

TABLE I-continued

| Pr | 30 | T | Xt | Xpos | XI | Xneg | closure |
|---|---|---|---|---|---|---|---|
| | | 3.25 | 0.2049 | 0.204 | 0.017 | −0.528 | 0.73 |
| | | 3.375 | 0.2198 | 0.219 | 0.027 | −0.519 | 0.74 |
| | | 3.5 | 0.2353. | 0.234 | 0.039 | −0.507 | 0.74 |
| | | 3.625 | 0.2513 | 0.250 | 0.053 | −0.492 | 0.74 |
| | | 3.75 | 0.2679 | 0.267 | 0.070 | −0.476 | 0.74 |
| | | 3.875 | 0.2849 | 0.284 | 0.088 | −0.457 | 0.74 |
| | | 4 | 0.3026 | 0.302 | 0.109 | 4.437 | 0.74 |

Table II sets forth the same calculations for the FIG. 9 embodiment in which the only change is that Dr is 18 inches. As these calculations demonstrate, the secondary links 46 provide adequate rearward movement coupled with the blade guard's (22) positive movement, to effect locking of the elements of the blade guard assembly 20 for all thickness of material. While the FIG. 9 embodiment is operational, the FIG. 1A embodiment provides superior locking and is, therefore, preferred.

TABLE II

| Pr | 30 | T | Xt | Xpos | XI | Xneg | closure |
|---|---|---|---|---|---|---|---|
| Dr | 18 | 0 | 0.0010 | 0.000 | 0.211 | 0.000 | 0.000 |
| f | 2.75 | 0.25 | 0.0023 | 0.001 | 0.192 | −0.019 | 0.02 |
| o | 0.25 | 0.25 | 0.0042 | 0.003 | 0.174 | −0.037 | 0.04 |
| | | 0.375 | 0.0065 | 0.005 | 0.157 | −0.054 | 0.06 |
| | | 0.5 | 0.0094 | 0.008 | 0.141 | −0.070 | 0.08 |
| | | 0.625 | 0.0128 | 0.012 | 0.126 | −0.085 | 0.10 |
| 0.00104168 | Xo | 0.75 | 0.0167 | 0.016 | 0.111 | −0.100 | 0.12 |
| 0.00104168 | | 0.875 | 0.0211 | 0.020 | 0.098 | −0.113 | 0.13 |
| | | 1 | 0.0261 | 0.025 | 0.085 | −0.126 | 0.15 |
| 0.21130977 | Xr | 1.125 | 0.0315 | 0.030 | 0.074 | −0.138 | 0.17 |
| 0.211 | | 1.25 | 0.0375 | 0.036 | 0.063 | −0.149 | 0.19 |
| | | 1.375 | 0.0440 | 0043 | 0.053 | −0.159 | 0.20 |
| | | 1.5 | 0.0511 | 0.050 | 0043 | −0.168 | 0.22 |
| | | 1.625 | 0.0587 | 0.058 | 0.035 | −0.176 | 0.23 |
| | | 1.75 | 0.0667 | 0.066 | 0.028 | −0.184 | 0.25 |
| | | 1.875 | 0.0754 | 0.074 | 0.021 | −0.190 | 0.26 |
| | | 2 | 0.0845 | 0.083 | 0.016 | −0.196 | 0.28 |
| | | 2.125 | 0.0942 | 0.093 | 0.011 | −0.200 | 0.29 |
| | | 2.25 | 0.1043 | 0.103 | 0.007 | −0.204 | 0.31 |
| | | 2.375 | 0.1151 | 0.114 | 0.004 | −0.207 | 0.32 |
| | | 2.5 | 0.1263 | 0.125 | 0.002 | −0.210 | 0.33 |
| | | 2.625 | 0.1381 | 0.137 | 0.000 | −0.211 | 0.35 |
| | | 2.75 | 0.1504 | 0.149 | 0.000 | −0.211 | 0.36 |
| | | 2.875 | 0.1632 | 0.163 | 0.000 | −0.211 | 037 |
| | | 3 | 01766 | 0.176 | 0.002 | −0.210 | 0.39 |
| | | 3.125 | 0.1904 | 0.189 | 0.004 | −0.207 | 0.40 |
| | | 3.25 | 0.2049 | 0.204 | 0.007 | −0.204 | 0.41 |
| | | 3.375 | 0.2198 | 0.219 | 0.011 | 0.200 | 0.42 |
| | | 3.5 | 0.2353 | 0.234 | 0.016 | −0.196 | 0.43 |
| | | 3.625 | 0.2513 | 0.250 | 0.021 | −0.190 | 0.44 |
| | | 3.75 | 0.2679 | 0.267 | 0.028 | −0.184 | 0.45 |
| | | 3.875 | 0.2849 | 0.284 | 0.035 | −0.176 | 0.46 |
| | | 4 | 0.3026 | 0.302 | 0.043 | −0.168 | 0.47 |

The locking slot 50 will preferably be equipped with serrated teeth (not shown) to prevent slippage between the elements of blade guard assembly 20. Blade guard assembly 20 will attempt to pivot about the pivot of links 46. This will generate a force $F_1$ in the FIG. 1A embodiment and a force $F_2$ in the FIG. 9 embodiment. However, such motion will be opposed by the rigidity of the primary linkage 46 or 48 that not share links' 46 pivot point, links 28 in the FIG. 1A embodiment, links 26 in the FIG. 9 embodiment. Hence, any lifting force that contact between the saw 11 and workpiece 14 may generate will be positively resisted by the rigidity of structure and not merely by a passive weight of a blade guard.

Figure 4:
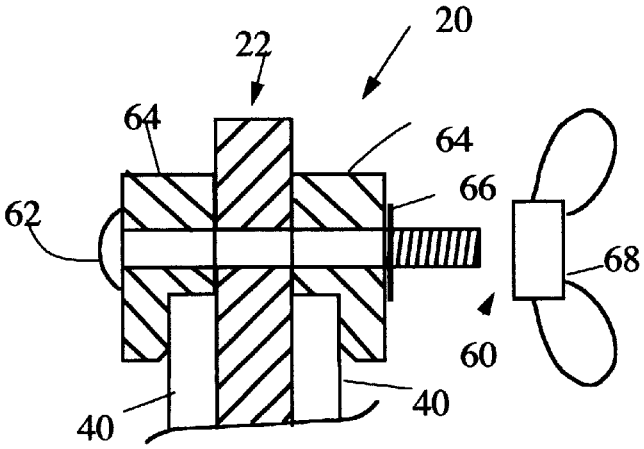
FIG. 4 is a cross-sectional end view as seen along 4—4 of FIG. 1A showing a detail of the means for locking the lifter to the blade guard.
Figure 5:
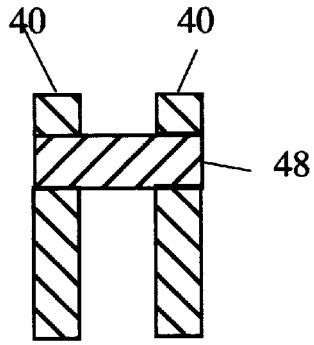
FIG. 5 is a cross-sectional end view as seen along 5—5 of FIG. 1A showing a detail of the locking rod that locks the lifter to the blade guard.

Means 60 is provided to lock blade guard and lifter 24 together in a elevated position for repetitive cuts of the same thickness of workpiece. Means 60 (FIG. 4) to lock the blade guard assembly 20 into a single unit comprises a bolt 62, two platelets 64, a lock washer 66 and a wing nut 68. After workpiece 14 is inserted under blade guard assembly 20, wing nut 68 can be tightened to pinch platelets 64 mounted on blade guard 22 against the sides of plates 40. This will lock lifter 24 to guard 22 and both in the upper operational position at a distance t from the table top 15.

Figure 10:
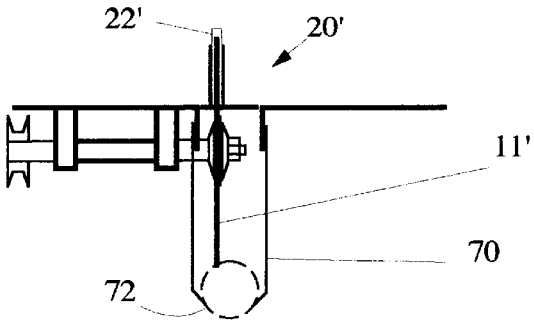
FIG. 10 is an end view of a third embodiment including a dust removal system.

FIG. 10 depicts a third embodiments of a blade guard assembly 20'. Many applications for table saws will require simple straight cuts for which the costly and space consuming inclusion of blade elevating and angle adjustment means will be unnessary. FIG. 10 teaches the use of such a simplified saw blade 11'. A lower housing 70 is provided which has a funnel portion 72 that may be attached to a means of suction (not shown). The use of lower housing 70 with dust removal suction will greatly reduce the hazard of chemical compounds borne in the dust as well as cleanup time required for the table saw. Such a saw will hold particular attraction for wood shop applications in schools and factories. Coupled with the added saftey provided by the entire blade 11' being surrounded by blade guard 22' and housing 70, such a configuration of table saw will be widely sought, particularly with the cost savings that the elimination of the elevating and angle adjustment features will provide.

The blade guard assembly 20 uses relative motion between the blade guard 22 and the lifter 24 to effect locking of the two primary components of assembly 20 to lock together. Any lifting force created by the saw's (11) interaction with workpiece 14 will be reacted into the primary linkage 26 or 28 that does not share a pivot with secondary linkage 46. The blade guard 22 and lifter 24 combine to completely surround the portion of saw 11 that extends above table top 15 providing significant safety enhancements over other blade guards. In addition, the reaction of the lifting forces into one of the dual links 26, 28 provides positive control of such forces, forces that can pose a significant threat to the safety of the worker if they succeed in getting the workpiece airborne. The blade guard assembly 20 of the present invention precludes the possibility of such a dangerous situation. Lastly, in the third embodiment, the fully extended blade with the surrounding guard 20 ' will greatly reduce the risk of particulate material being thrown back into the face of the user.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A blade guard assembly (20) for a table saw which includes a table top (15) and a saw blade (11), said blade guard assembly comprising a) a blade guard (22) for the saw blade, said blade guard having i) a first protective position in which the peripheral portion of the saw blade above the table top is surrounded and a second elevated position permitting a workpiece to engage the saw blade, and ii) a laterally protruding bearing means (38) extending from side portions of said blade guard;

b) linkage means (25) pivotally attached to said blade guard and to a portion of the table top remote from the saw blade;

c) a lifter (24) having a forward camming surface (41) for engaging a workpiece (14) as it is moved toward the saw blade, said lifter having an upper surface (43) which engages said bearing means and lifts said blade guard to said second elevated position;

d) a secondary link (46) pivotally attached between said lifter and the portion of the table top (17) remote from the saw blade in a manner to produce forward movement of said lifter as the workpiece engages the saw blade;

e) first locking means (48) on said lifter which engages second locking means (50) on said blade guard to lock said lifter to said blade guard such that said blade guard assembly moves together as a unit as a result of said forward movement of said lifter;

whereby locking of said blade guard to said lifter has the effect of reacting any torsional force into said linkage means to oppose any lifting force the saw blade may impart to the workpiece.

2. The safety equipment of claim 1 wherein said lifter comprises first and second lifter plates (40) positioned on either side of said blade guard and operable to surround lateral portions of the blade (11) positioned above the table top (15).

3. The safety equipment of claim 2 wherein said linkage means further comprises a first primary link (26) having a first length and a second primary link (28) having a second length, said first and second lengths being generally the same.

4. The safety equipment of claim 3 wherein said first and second primary links are attached to said blade guard at first and second points spaced by a first distance and to the portion of the table top remote from the saw blade at third and fourth points spaced by a second distance, wherein said first and second distances are generally the same producing a parallelogram linkage.

5. The safety equipment of claim 4 wherein said secondary link is pivotally attached to the portion of the table top remote from the saw blade at a pivot point of one of said first and second primary linkages.

6. The safety equipment of claim 4 wherein the portion of the table top to which said first and second primary links and said secondary link are pivotally attached comprises a splitter adapted to physically separate two portions which have been sawn apart.

7. The safety equipment of claim 4 further comprising means to lock one of said pivot points of said parallelogram linkage in a fixed position to permit said blade guard and said lifter to be held in said second upper position for repetitive cutting of boards having the same thickness.

8. The safety equipment of claim 7 wherein said means to lock one of said pivot points comprises a bolt and wingnut and first and second clamping platelets, said bolt and wing nut attaching said first and second clamping platelets to said blade guard and being manually operable to pinch said first and second lifter plates in a region near their centroids and thereby be clamped thereto.

9. The safety equipment of claim 1 further comprising a toothed pawl pivotally attached to a forward portion of said lifter, said toothed pawl engaging an upper surface portion of the workpiece and providing an anti-lifting force.

10. The safety equipment of claim 9 wherein said toothed pawl is pivotally attached to said forward portion of said lifter behind said bearing means.

11. The safety equipment of claim 1 wherein said first and second locking means comprise a locking rod positioned on a first one of said blade guard and said lifter and a locking slot on a second one of said blade guard and said lifter for receiving said locking rod as said lifter experiences forward movement.

12. The safety equipment of claim 1 further comprising a housing surrounding a lower peripheral portion of said blade, said housing equipped with dust removal means.

* * * * *